US006651856B1

(12) United States Patent
Perry

(10) Patent No.: US 6,651,856 B1
(45) **Date of Patent: *Nov. 25, 2003**

(54) DEVICE FOR SUSPENDING A RECORDER AND METHOD FOR USING THE SAME

(76) Inventor: Andrew M. Perry, 2041 State St., Salem, OR (US) 97301

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/689,721

(22) Filed: Aug. 12, 1996

(51) Int. Cl.[7] ..... G10G 5/00

(52) U.S. Cl. ..... 224/604; 224/251; 224/910; 984/257

(58) Field of Search ..... 224/251, 250, 224/605, 604, 257, 910, 258, 148.1, 148.4–148.7; 84/385 A, 387 A, 453, 380 R, 380 C, 470 R; 24/3.4; D3/204; 984/128, 139, 257; D17/13

(56) References Cited

U.S. PATENT DOCUMENTS

| | | | | | |
|---|---|---|---|---|---|
| 3,186,611 | A | * | 6/1965 | Sonderman | 224/605 |
| 3,363,497 | A | * | 1/1968 | Thompson | 80/380 R |
| 4,355,804 | A | * | 10/1982 | Bingham | 224/251 X |
| 4,674,298 | A | * | 6/1987 | Wimmershoff-Caplan | 224/251 X |
| 4,841,829 | A | * | 6/1989 | Lehmann | 224/910 |
| 4,884,730 | A | * | 12/1989 | Carpenter | 224/251 X |
| 5,167,356 | A | * | 12/1992 | Williams | 224/604 |
| 5,203,481 | A | * | 4/1993 | Dobbins et al. | 224/148 |
| 5,398,855 | A | * | 3/1995 | Schaiewitz | 224/250 X |

FOREIGN PATENT DOCUMENTS

| | | | | |
|---|---|---|---|---|
| CA | 957345 | * | 11/1974 | 224/910 |

* cited by examiner

*Primary Examiner*—Renee Luebke
(74) *Attorney, Agent, or Firm*—Marger Johnson & McCollom, P.C.

(57) ABSTRACT

An apparatus for the carrying of a woodwind musical instrument, known as a recorder, consisting of a ring with sufficient inside diameter to fit around the shaft of the recorder and a strap attached to the ring and of sufficient length so as to fit around the neck of the person playing the recorder and allowing the recorder to hang in a position of easy access to the user.

3 Claims, 3 Drawing Sheets

DEVICE FOR SUSPENDING A RECORDER AND METHOD FOR USING THE SAME

BACKGROUND OF THE INVENTION

1. Field of the Invention

This invention pertains to the general field of a neck strap arrangement for carrying a musical instrument. In particular, it provides a new and improved method of carrying a woodwind musical instrument known as a recorder.

2. Description of Prior Art

The recorder is an instrument that is of such size that it can be carried easily. This instrument is most often used by children in early grade school for instruction in music. Most often the child will purchase a recorder. The child will then carry the recorder to class and carry it in the hand during class. If the child needs to use the hands for another purpose, the recorder is laid down and subject to loss or confusion when play is to be continued. Also, like anything a child is forced to carry in their hands, the object can be inappropriately used as a toy, weapon, or whatever fits the occasion.

Prior art is limited to some resourceful teachers that have simply tied a string around the recorder with some sort of loop that is placed around the child's neck to suspend the recorder. Because the knots may slip, come untied or can not be readily untied, this method has not gained wide support. In addition, after the teacher has tied all the knots required by the students, the teacher has little time left for instruction. Thus, at the present time, there is no suitable means for the hand free carrying of the recorder.

SUMMARY OF INVENTION

It is therefore an objective of this invention to provide a device for conveniently carrying a recorder securely affixed to a strap that is worn about the neck.

Another objective of the invention is the realization of the above mentioned objective with simple, reliable and inexpensive hardware.

In accordance with these and other objectives, the method and apparatus of this invention consist of a ring and an attached strap. The ring is made of resilient material and is of sufficient inside diameter so as to fit, after the strap has been secured to the ring, snugly around the shaft of the mouth piece of the recorder. The ring is secured on the recorder by pulling the recorder apart at its dividing point and then slipping the ring around the mouth piece section and sliding it up the shaft until it is securely lodged on the shaft. Because the diameter of the shaft, of the mouth piece section, increases from the separation point towards the other end, the ring will be secure on the recorder shaft approximately one inch from the dividing point. The two pieces of the recorder are then reconnected.

Various other purposes and advantages of the invention will become clear from its description in the specifications that follows, and from the novel features particularly pointed out in the appended claims. Therefore, to the accomplishment of the objectives described above, this invention consists of the feature hereinafter illustrated in the drawings, fully described in the detailed description of the preferred employment and particularly pointed out in the claims. However, such drawings and description disclose only some of the various ways in which the invention may be practiced.

BRIEF DESCRIPTION OF THE DRAWINGS

This invention together with its features and advantages can be better understood from the following description when read in conjunction with the drawings in which.

DETAILED DESCRIPTION OF INVENTION

The heart of this invention lies in the simple ring, which makes it possible to conveniently attach a strap to a recorder. Thus, the main objective of providing an easy method to carry a recorder is met.

Figure 1:
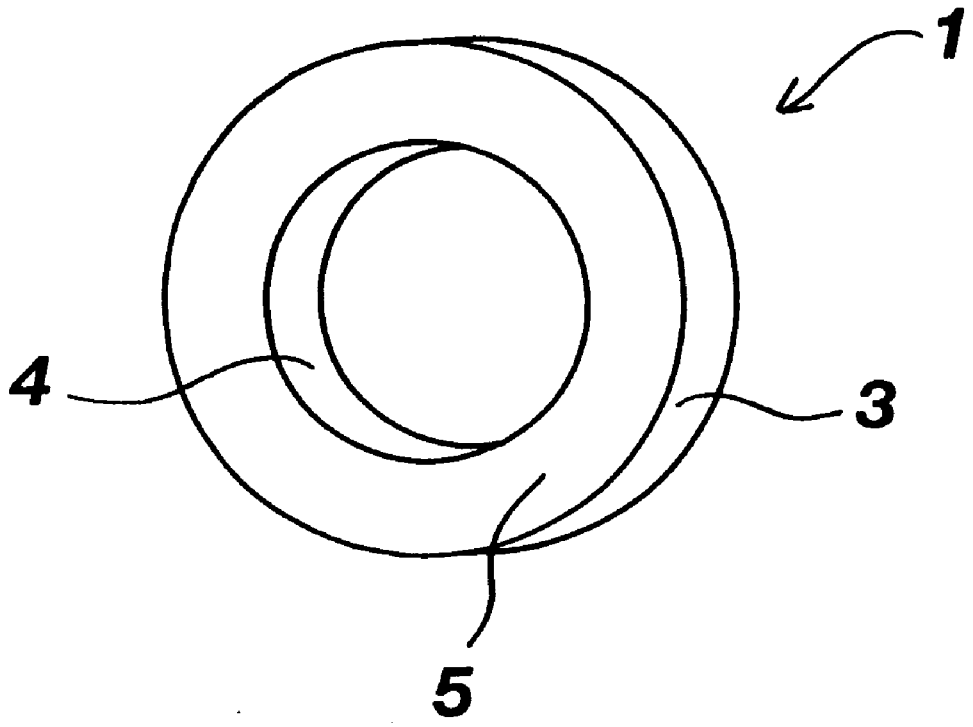
FIG. 1 is a perspective view of the ring of the device of the invention.
Figure 2:
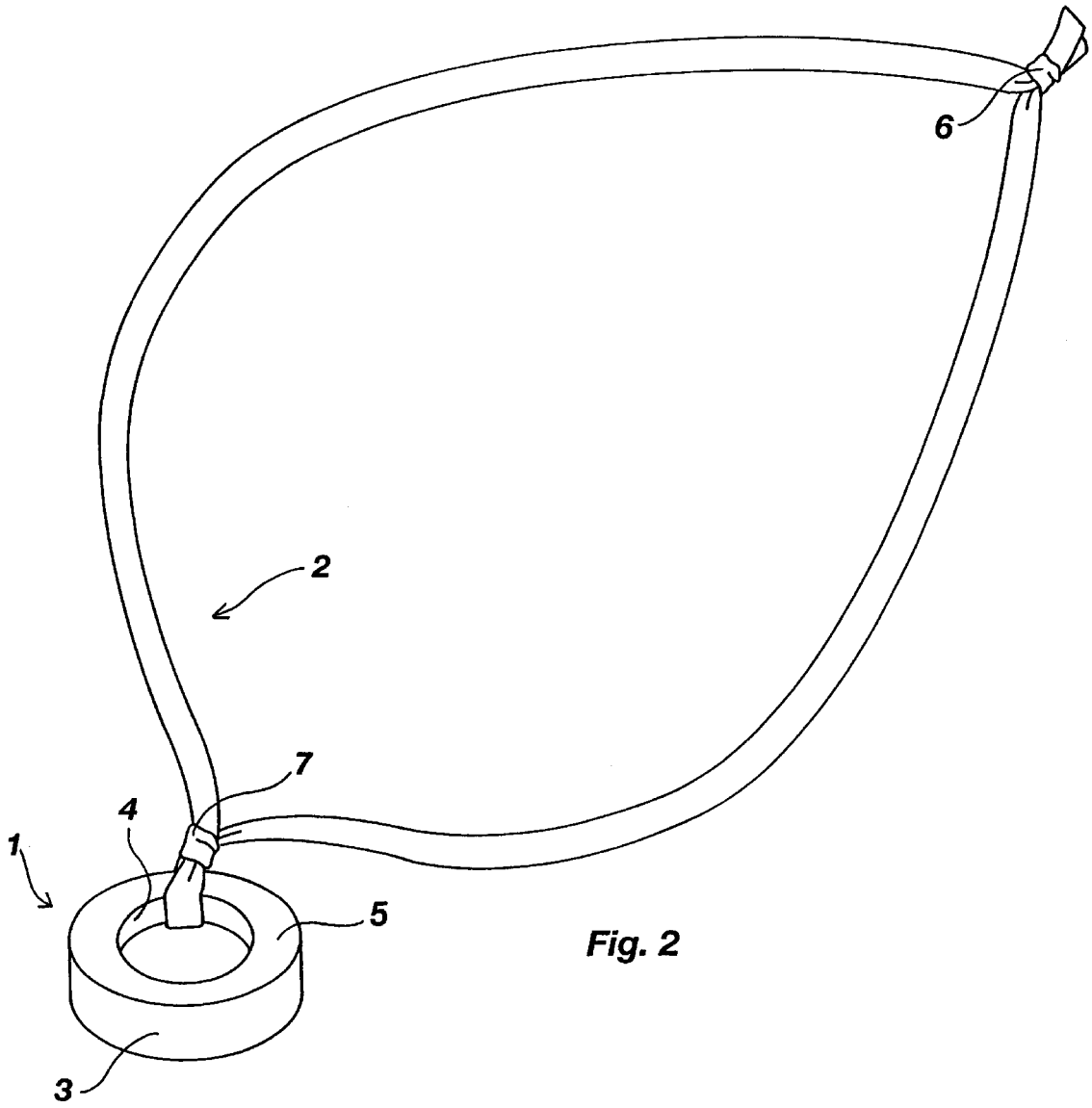
FIG. 2 is a perspective view of the device of the invention.
Figure 3:
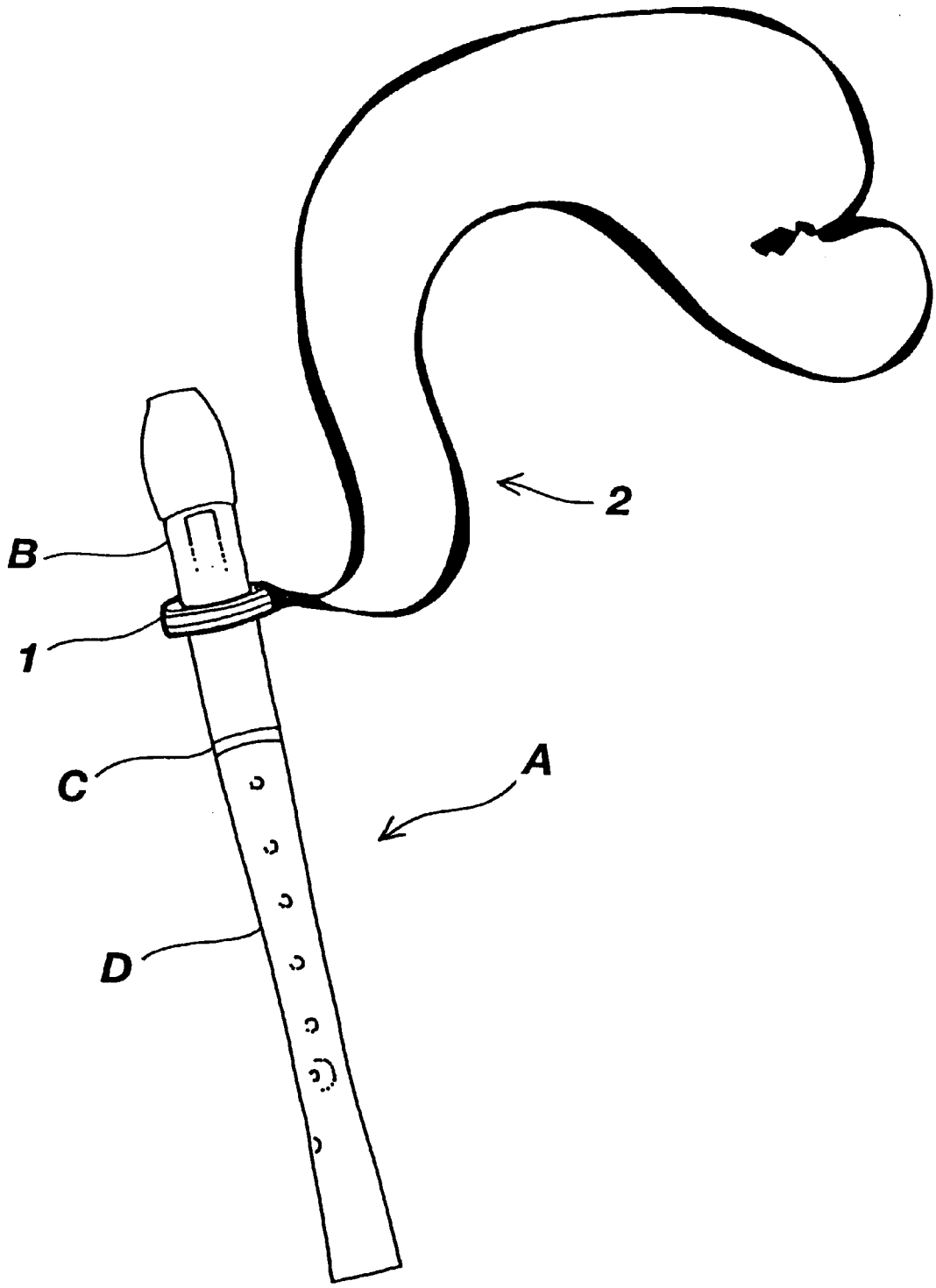
FIG. 3 is a perspective view of the device attached to a recorder.

Referring to the drawings, wherein the same reference numbers and symbols are used throughout to designate like parts, FIG. 1 illustrates the general configuration of the ring 1 before the strap 2 is attached and it is mounted on the recorder A.

The ring 1 has a surface 3 and 5 of such dimensions so as to provide strength enough to withstand the rigors and forces that would be anticipated when the device is in use by elementary age school children. As illustrated in FIG. 1, the precise geometry of the inner surface 4 of the ring is a circle with a diameter larger than the diameter of the recorder A at the point of the juncture C of the two pieces B and D of the recorder A. The diameter of the mouth piece B section of the recorder A increases from the separation point C to the air hole of the mouth piece B located just above the mid point of the mouth piece B.

The strap 2 is made of a material that is strong enough to hold the recorder or other desired object, yet be comfortable when placed around the neck. The knot 7 is tied in the middle of strap 2 after placing one end through the ring 1. Knot 6 is any knot that will neatly secure the ends of the strap 2.

The ring 1 is attached to the recorder A by pulling apart the two pieces B and D of the recorder A at the separation point C. The ring 1 is then slid onto the shaft of the mouth piece B of the recorder 1 at the end that attaches to the fingering piece D of the recorder A. The ring 1 will slip onto the mouth piece B and then lodge at a point approximately one inch up the shaft due to the slight taper of the shaft.

After a suitable strap is attached to the appropriate size ring, the ring is attached to a recorder by slipping the ring onto the upper section of the recorder. The strap may be adjusted so the recorder hangs comfortably from the neck of the person playing the recorder.

While the present invention has been shown and described herein in what is believed to be the most practical and preferred embodiment, it is recognized that departures can be made therefrom within the scope of the invention, which is therefore not to be limited to the details disclosed herein, but is to be accorded the full scope of the claims so as to embrace any and all equivalent apparatus and methods.

What is claimed is:

1. A method for suspending a recorder from a neck of a user using a device that comprises a strap and a ring attached to the strap, the recorder comprising a lower section and an upper section joined at a juncture point, the recorder having a distal end belonging to the lower section and a proximate end belonging to the upper section, the recorder further having a mouthpiece at the proximate end, the upper section having a diameter that increases gradually from the juncture point to the mouthpiece, the method comprising the steps of:

selecting a ring sized to have an inner diameter defining an inner portion of the ring at least as large as the diameter of the upper section at the juncture point and smaller than the diameter of the upper section at the mouthpiece;

pulling the recorder apart at the juncture point, thereby separating the lower section from the upper section;

inserting through the inner portion of the ring an end of the upper section that is associated with the juncture point and is opposite to the proximate end, and sliding the ring towards the mouthpiece, the ring thereby becoming lodged around the upper section, wherein lodging the ring around upper section creates an interference fit between the upper section and the inner portion of the ring to support the recorder in a way that does not interfere with any of the air holes of the recorder;

reconnecting the lower and upper sections at the juncture point; and suspending the strap from the neck of the user.

2. A method for suspending a recorder from a neck of a user using a device that comprises a strap and a ring attached to the strap, the recorder comprising a lower section and an upper section joined at a juncture point, the recorder having a distal end belonging to the lower section and a proximate end belonging to the upper section, the recorder further having a mouthpiece at the proximate end, the upper section having a diameter that increases gradually from the juncture point to the mouthpiece, the method comprising the steps of:

selecting a ring having an inner diameter at least as large as the diameter of the upper section at the juncture point and smaller than the diameter of the upper section at the mouthpiece;

suspending the strap from the neck of the user;

pulling the recorder apart at the juncture point, thereby separating the lower section from the upper section; and inserting through the ring an end of the upper section that is associated with the juncture point and is opposite to the proximate end, and sliding the ring towards the mouthpiece, the ring thereby becoming lodged around the upper section.

3. The method of claim 2, further comprising reconnecting the lower and upper sections at the juncture point.

* * * * *